US008164414B2

(12) United States Patent
Tanaka et al.

(10) Patent No.: US 8,164,414 B2
(45) Date of Patent: Apr. 24, 2012

(54) POLYMER PTC ELEMENT

(75) Inventors: Arata Tanaka, Ryugasaki (JP); Keiichiro Nomura, Choshi (JP)

(73) Assignee: Tyco Electronics Japan G.K., Kawasaki-shi (JP)

( * ) Notice: Subject to any disclaimer, the term of this patent is extended or adjusted under 35 U.S.C. 154(b) by 786 days.

(21) Appl. No.: 11/629,049

(22) PCT Filed: May 31, 2005

(86) PCT No.: PCT/JP2005/009962

§ 371 (c)(1), (2), (4) Date: Sep. 29, 2008

(87) PCT Pub. No.: WO2005/122190

PCT Pub. Date: Dec. 22, 2005

(65) Prior Publication Data

US 2009/0045908 A1 Feb. 19, 2009

(30) Foreign Application Priority Data

Jun. 8, 2004 (JP) ..... 2004-169804

(51) Int. Cl.
*H01C 7/00* (2006.01)

(52) U.S. Cl. ..... 338/22 R

(58) Field of Classification Search ..... 338/22 R; 219/504–505, 541, 548

See application file for complete search history.

(56) References Cited

U.S. PATENT DOCUMENTS

| | | | |
|---|---|---|---|
| 4,689,475 | A | 8/1987 | Kleiner et al. |
| 5,928,547 | A | 7/1999 | Shea et al. |
| 2005/0072270 | A1 | 4/2005 | Kato et al. |

FOREIGN PATENT DOCUMENTS

| | | | |
|---|---|---|---|
| JP | 64-056775 | A | 3/1989 |
| JP | 4-28743 | B | 5/1992 |
| JP | 5-47503 | A | 2/1993 |
| JP | 11-135303 | A | 5/1999 |
| JP | 2000-216002 | A | 8/2000 |
| JP | 2001-85202 | A | 3/2001 |
| JP | 2002-110403 | A | 4/2002 |
| JP | 2004-71868 | A | 3/2004 |
| WO | WO-2005/023461 | A | 3/2005 |

OTHER PUBLICATIONS

International Search Report for International Application No. PCT/JP2005/009962, mailed Sep. 13, 2005.

Supplementary European Search Report for European Application No. 05746056, mailed Oct. 23, 2009.

*Primary Examiner* — Kyung Lee

(57) ABSTRACT

There is provided a polymer PTC device which has a further improved performance.

Such PTC device comprises (A) a polymer PTC element containing (a1) an electrically conductive filler and (a2) a polymer material, and (B) at least one metal electrode disposed on at least one surface of the polymer PTC element, and the electrically conductive filler is an Ni alloy filler which has oxidation resistance under a high temperature and dry atmosphere, and the polymer material is a thermoplastic crystalline polymer.

11 Claims, 6 Drawing Sheets

POLYMER PTC ELEMENT

TECHNICAL FIELD

The present invention relates to a polymer PTC (positive temperature coefficient) device which comprises a PTC element containing, as a conductive filler, an Ni alloy filler (e.g. particles or powder of a nickel-cobalt alloy) having oxidation resistance under a high temperature and dry atmosphere, particularly to such a device for use as a circuit-protection device, and also to an electric apparatus in which the same device is incorporated.

BACKGROUND OF THE INVENTION

A PTC device is used as circuit-protection device which protects, for example, electric circuits, in a variety of electric or electronic apparatuses. Such PTC device shows an electric resistance which changes depending on a temperature. In general, the PTC device has such property that its resistance rapidly increases when its temperature elevates from a room temperature so as to exceed a specific threshold temperature called a trip temperature. The property as above, namely, increase, preferably rapid increase in the resistance in association with increase in temperature, is called a "PTC characteristic", and such a rapid increase in resistance is called "trip". When concentrated attentions are paid to a switching function of a PTC device as will be described later, a trip temperature is also called a switching temperature.

As described above, the PTC device is used by being integrated into an electric circuit of an electric or electronic apparatus. For example, when an excess of current passes through the electric circuit including the PTC device for some reasons while such an apparatus being used so that the temperature of the PTC device accordingly elevates to the threshold temperature, or otherwise, when an ambient temperature around the apparatus rises to elevate the temperature of the PTC device to the threshold temperature, the resistance of the PTC device rapidly becomes higher, namely, the PTC device trips. Particularly when a PTC device is used as a protective circuit in an electronic apparatus, it is essential that the resistance change of the PTC device from a temperature just below the threshold temperature to a temperature just above the threshold temperature should be rapidly large and such change should be at least 100 times, preferably 1,000 or more times larger. Especially, a function of the PTC device showing such a rapidly large change is called a "switching function".

In an actual temperature-resistance curve obtained from a PTC device, the resistance change of the PTC device from the temperature just below the threshold temperature to the temperature just above the threshold temperature is an steep change within a certain temperature range, but not a stepwise change (that is, a change showing a curve slope of substantially 90°). Accordingly, the wording of "a change in resistance from the temperature just below the threshold temperature to the temperatures just above the threshold temperature" herein used throughout the present description is intended to mean a ratio of a resistance found just after such a rapid change to a resistance found just before the rapid change. In general, the PTC device shows a very large change in its resistance, and therefore, the resistance found just before such a rapid change may be regarded as being equal to a resistance found at a room temperature in view of practical use.

For example, referring to the measured data indicated in FIG. 2, a device of Example 1 showed a rapid increase in its resistance within a temperature range between about 100° C. and about 130° C. In this case, the change in resistance corresponds to a ratio of a resistance at 130° C. to a resistance at 20° C., and this ratio of the change in resistance is in the range of between about $10^4$ and about $10^5$.

When such a PTC device is incorporated into an electric circuit to be disposed in a power supply line, the PTC device of which resistance has increased substantially shuts off a current (namely switches off) so as to thereby prevent a possible failure of the apparatus beforehand. When such a PTC device forms a protection circuit in an apparatus in another embodiment, the PTC device becomes of a higher resistance because of an abnormal rise of an ambient temperature, and consequently, the PTC device switches to stop the application of voltage in the protection circuit so as to prevent a failure of the apparatus beforehand. This "switching function" of the PTC device is well-known to the art, and various kinds of the PTC devices have been used. For example, a PTC device having such "a switching function" is incorporated into a protection circuit in an electric circuit of a secondary battery for a cellular telephone. When an excess of current passes through the secondary battery which is being charged or discharged, the PTC device shuts off the current to protect the cellular telephone, for example, the secondary battery thereof.

The trip or switching temperature and the switching function as mentioned above are also disclosed, for example, in Patent References 1 and 2 described below. These References can be referred to in relation to the present invention, and the contents disclosed in these References constitute a part of the present description by reference.

As one of the conventional PTC devices, there is known a polymer PTC device which comprises a layered (or planar) polymer PTC element made of a thermoplastic crystalline polymer material as a base material which contains a conductive filler dispersed therein as electrically conductive particles (see for example Patent References 3). The layered polymer PTC element can be manufactured by extruding a high density polyethylene which contains an electrically conductive filler such as carbon black dispersed therein. A polymer PTC device is fabricated by disposing suitable electrodes on both main surfaces of the polymer PTC element. For example, metal foil electrodes are used as such electrodes. The metal foil electrodes are bonded on the layered polymer PTC element, for example, by thermo-compression bonding.

Why the polymer PTC device can exhibit the above-described switching function can be explained as follows with reference to FIGS. 1(*a*) and 1(*b*): FIGS. 1(*a*) and 1(*b*) schematically show electrically conductive particles (e.g. carbon black powder) which are dispersed in a thermoplastic crystalline polymer of the polymer PTC element, illustrating the dispersing conditions of the conductive particles which are found before the trip (at a normal or room temperature or under normal conditions) and upon the trip, respectively. The thermoplastic crystalline polymer includes a crystal portion in which the polymer chains are regularly and densely aligned, and an amorphous portion in which the polymer chains are present coarsely and randomly. Consequently, it is physically hard for the conductive particles to enter the crystal portion having the polymer chains densely aligned therein, and thus, the conductive particles are concentrated and collected in the amorphous portion of the polymer. This fact means that the conductive particles are densely present in contact with one another in the amorphous portion of the polymer, and it is considered from this phenomenon that the polymer PTC element is low in its electrical resistance.

On the other hand, when the temperature of the polymer PTC element rises, the crystal portions in which the polymer chains have been regularly and densely aligned at a normal temperature gradually transfer to an amorphous state where the polymer chains are present at random, because the molecular motions become more active with an increase in temperature. When the temperature of the polymer PTC element reaches the trip temperature which is around a melting point of the crystalline polymer, the crystal portions of the crystalline polymer start melting, so that the amorphous portions of the polymer increase. This state of the PTC element is schematically shown in FIG. 1(*b*). In this state, the movement of the conductive particles, which has been restricted due to the crystal state at a normal temperature, becomes possible. As a result, appreciable amounts of the conductive particles are away from one another, and thus, it is considered that the electric resistance of the polymer PTC element becomes higher.

The above increase in the electric resistance of the polymer PTC element can be achieved by making use of a phenomenon of conductive particles' moving away from one another due to the volume expansion of the polymer in addition to or instead of the melting of the crystal portions. However, to achieve a larger change ratio in electric resistance (i.e. a ratio of a resistance upon a trip/a resistance found before the trip (or a resistance found at a normal temperature), it is preferable to use, for the polymer PTC element, a polymer of which crystal state becomes amorphous in place of and preferably in addition to exhibiting the volume expansion. When a non-crystalline polymer such as a thermosetting resin is used to manufacture a PTC element, it is possible to achieve a slight change (usually several times to several tens times larger) in electrical resistance attributed to a transition point such as a glass transition point, but it is impossible to achieve a change ratio in resistance (generally at least 1,000 times larger) which makes it possible to exhibit a switching function required to be used as a circuit protection device.

In order to improve the characteristics of the above mentioned polymer PTC elements, various new studies have been continuously carried out: for example, there has been carried out a study to obtain a large change in resistance and an acute rise in a temperature-resistance curve while lessening an initial resistance of a PTC device at a room temperature. As one of such examples, a study is reported wherein nickel powder is used as an electrically conductive filler (see for example Patent References 3).

Patent References 1: JP-B-4-28743 (1992)
Patent References 2: JP-A-2001-85202 (2001)
Patent References 3: JP-A-5-47503 (1993)

DISCLOSURE OF THE INVENTION

Problems to be Solved by the Invention

The requirements commonly demanded for the above mentioned polymer PTC devices are that the devices show a lower resistance at a room temperatures, and that their performance is not easily deteriorated relative to their operation periods. The existing commercially available polymer PTC devices show acceptable performance to meet these requirements when used in electrical apparatuses, however, the performance is still expected to be further improved. An object of the present invention is therefore to provide a polymer PTC device having a further improved performance.

Means for Solving the Problems

As a result of the present inventors' extensive studies about polymer PTC devices, it has been found that PTC devices comprising a nickel filler as an electrically conductive filler show a small resistance at a room temperatures in initial stages after the start of using thereof, but show aging changes, that is, increases in their resistance, as the operation times in electrical apparatuses become longer.

In the studies of aging changes of electronic components over a long period of time, the electronic components are, in many cases, subjected to a standard life tests, i.e., an acceleration test under a high temperature and high humidity atmosphere. It is a common knowledge that the electronic components having passed this test are predicted to have stability over a long period of time under normal conditions. However, the present inventors have found the following problem in the PTC devices using the nickel filler: the PTC device in which the nickel filler is used, even if having passed the above acceleration test under the high temperature and high humidity atmosphere, still has a problem of an aging change over a long period of time in that such a PTC device shows an increased resistance as the operation time used in an electric apparatus becomes longer. Thus, only such an acceleration test under the high temperature and high humidity atmosphere is insufficient to predict the long-term stability in the resistance of such a PTC device. That is, the present inventors have found that the use of a nickel filler as the electrically conductive filler in the PTC device is not so preferable because of the aging deterioration of the resistance characteristics of the PTC device, and therefore, they have found that the performance of such a PTC device should be improved relative to such an aging change.

In order to solve this problem, the present inventors have reached a need for providing a PTC device which is improved in its performance while suppressing the above mentioned aging change, and which is simultaneously improved in the PTC characteristic as much as possible (for example, showing a small resistance at a room temperature and showing an acute rise in resistance, and/or showing a large resistance change) by providing a polymer PTC element using a conductive filler which has never been used, and fabricating a PTC device comprising such PTC element.

The present inventors have further carried out various studies and found that the long term stability of a PTC device in its practical use can be predicted by an acceleration test under a high temperature and dry atmosphere (an atmosphere at a temperature of 85° C. and a relative humidity of not higher than 10%), but not by the conventionally used life test under the high temperature and high humidity atmosphere (typically an atmosphere at a temperature of 85° C. and a relative humidity of not lower than 85%), and also they have found that the use of a PTC element which contains "a specific electrically conductive filler" makes it possible to provide a PTC device of which need the present inventors have reached as described above, so that the present invention has been completed. In this regard, "the specific electrically conductive filler" herein referred to means a filler of a nickel alloy which can bring about an electrical resistance-increasing rate (before the trip) within a specific range, and an electrical resistance-increasing rate (after the trip) within a specific range in an aging change test under a high temperature and dry atmosphere as explained in Examples which will be described later. In the present description, such filler is also referred to as "an Ni alloy filler having oxidation resistance under a high temperature and dry atmosphere."

In the first aspect, the present invention provides a novel PTC device which comprises (A) a polymer PTC element comprising
(a1) an electrically conductive filler and
(a2) a polymer material, and (B) a metal electrode disposed on at least one surface of the polymer PTC element, and which is characterized in that the conductive filler is an Ni alloy filler having oxidation resistance under a high temperature and dry atmosphere, and the polymer material is a thermoplastic crystalline polymer. The PTC device according to the present invention has the above-described switching function.

Effect of the Invention

It has been confirmed that a PTC device using a conventionally known nickel metal filler shows an acceptable function under a high temperature and high humidity atmosphere which is commonly used for the conventional stability tests, and that such PTC device shows a largely increased resistance when practically used over a long period of time, and in some cases, such PTC device has a fatal defect for which the PTC device cannot be practically used. As a result of the present inventors' extensive studies for solving this problem, it has been found that an acceleration test under a high temperature and dry atmosphere is effective to predict the resistance stability of a PTC device which will work over a long period of time, instead of the conventional acceleration test under the high temperature and high humidity atmosphere, which has been believed as an optimal test method to predict the resistance stability of the PTC device which will be used over a long period of time.

In order to overcome the fatal defect of the PTC device using the nickel metal filler, a nickel alloy filler such as a nickel-cobalt alloy filler is used as a specific conductive filler as described in the present invention in a PTC device, so that the practical problems, i.e. the degradation of the performance of the polymer PTC device due to the aging deterioration, particularly the resistance increase with time of the polymer PTC device under the high temperature and dry atmosphere can be prevented, while maintaining the intrinsic performance of the polymer PTC device.

EMBODIMENT FOR CARRYING OUT THE INVENTION

Figure 1:
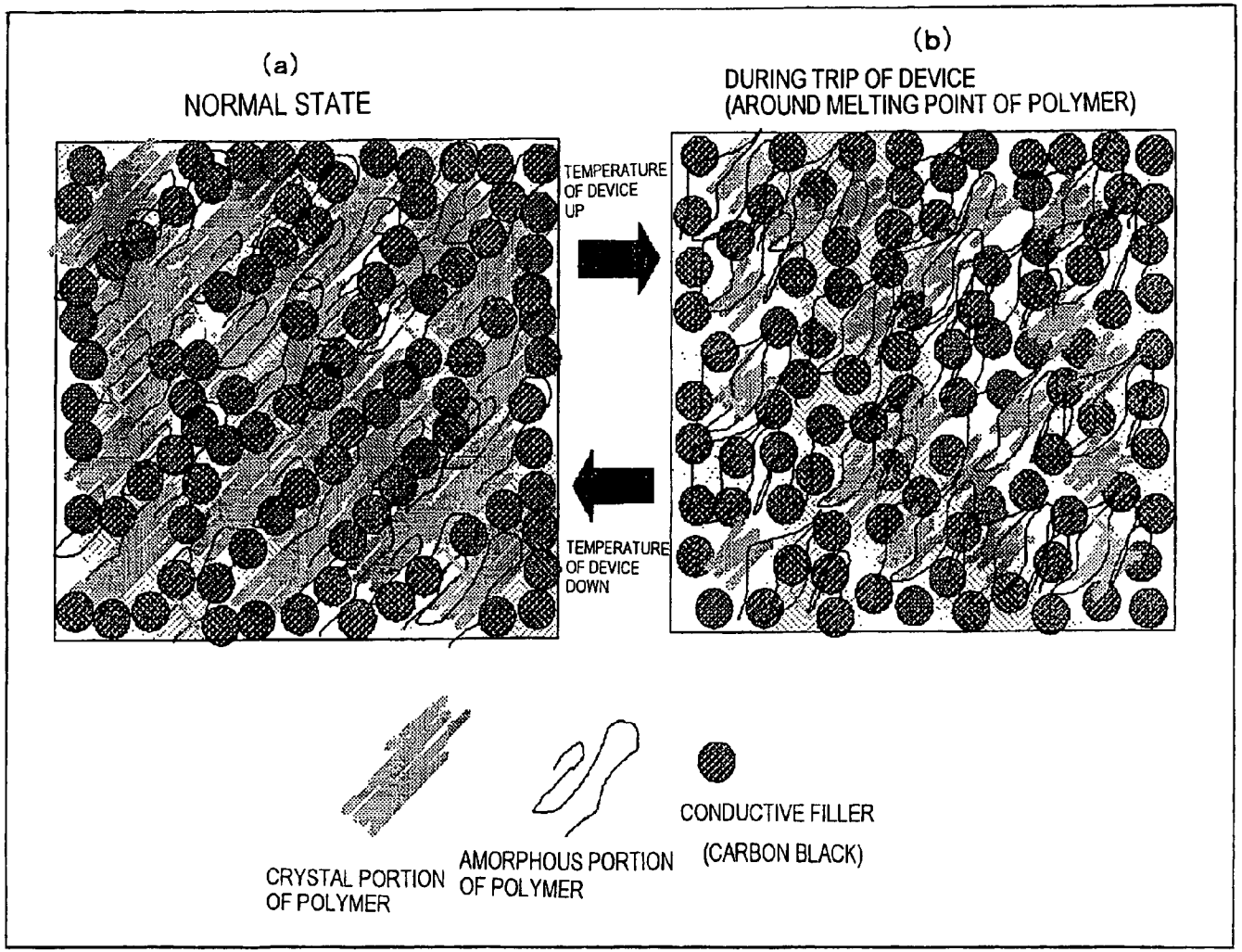
FIG. 1 shows schematic diagrams illustrating the temperature-resistance characteristics of a PTC device.

While it is impossible to perfectly explain the reasons why the PTC device according to the present invention can provide excellent effects, the following can be considered as one of possibilities based on lots of facts which hitherto have been found by the present inventors:

The present inventors have found that the PTC device using the nickel metal filler as a conductive filler shows a markedly increased resistance when stored under the high temperature and dry atmosphere, as compared with that of the PTC devices using the nickel alloy fillers according to the present invention.

In case of the PTC device using the nickel metal filler, it is considered that the oxidation of metal nickel proceeds with time due to an oxygen and a moisture in the air, with the result that nickel hydroxide ($Ni(OH)_2$) for example is formed as an oxide on a surface of the nickel metal filler. The nickel hydroxide shows a high electric resistance, and therefore it is considered that the electric conductivity of the nickel metal filler tends to be lowered, when a thick layer of the nickel hydroxide is formed on the surface of the nickel filler or when the nickel hydroxide is widely formed on the surface of the nickel filler.

In the meantime, when "other metal (or referred to as "a second metal")" which is baser than nickel (which corresponds to "a first metal") (namely, a metal having a lower standard electrode potential than that of nickel) is contained in a filler together with nickel, such "other metal" is more likely to be oxidized compared with nickel, and thus, it is considered that "other metal" may be more preferentially oxidized than the nickel in the filler. If the oxide formed by the oxidation of "other metal" is electrically more conductive than that of an oxide formed by the oxidation of nickel, the electrical conductivity of the filler is not so decreased, as compared with the decrease in the electrical conductivity which is brought about by the oxidation of the nickel.

One of examples of "other metal" baser than nickel is cobalt, which is oxidized to form an oxide such as cobalt hydroxide ($Co(OH)_2$), oxycobalt hydroxide (CoOOH) or the like. Cobalt hydroxide and oxycobalt hydroxide are electrically more conductive than nickel hydroxide, and are used as conductive materials for batteries. Particularly, oxycobalt hydroxide has a high electric conductivity (resistance=$10^{-7}$ to $10^{-1}\ \Omega^{-1}\cdot cm^{-1}$).

Accordingly, when "other metal" which is baser than nickel and which forms an electrically more conductive oxide than an oxide formed by nickel (provided that nickel and "other metal" are exposed to the same atmosphere) is present together with nickel in a filler, the presence of such "other metal" is effective to compensate a decrease in the electric conductivity of the filler attributed to the oxidation of nickel. An oxide of such "other metal" present on the surface and/or the interior of an elements (e.g. particles) which constitute the filler makes it possible to substantially maintain electrical conductivity network formed by the filler. As a result, it is considered that the PTC device containing the nickel alloy filler according to the present invention will show no marked increase in electrical resistance which is revealed as the deterioration of the device due to the aging change.

In this regard, when "other metal" is present also inside the elements which constitute the nickel alloy filler, such "other metal" can be still present in the elements, even if the elements which constitute the filler is mechanically ground and broken by various stresses applied to the filler in the step for manufacturing a polymer PTC device, such as a kneading step, an extrusion step, a heat treatment step, a radiation exposure step, etc. It is therefore considered that "other metal" may impart stable conductivity to the resultant polymer PTC device.

On the other hand, the following is expected to be one of possible reasons why the nickel metal filler shows a rapid increase in the resistance value under the high temperature and dry atmosphere, while showing sufficient stability in the resistance over a long period of time under the high temperature and high humidity atmosphere: the oxidation reactions of nickel and the types of an oxide of nickel are different between under the high temperature and high humidity atmosphere and under the high temperature and dry atmosphere. Consequently, large amounts of nickel oxides showing high resistances are formed under the high temperature and dry atmosphere, thus showing the rapid increases in resistance, while smaller amounts of such nickel oxides showing such high resistances are formed under the high temperature and high humidity atmosphere, thus showing no rapid increase in resistance.

While the foregoing is a possible explanation for the reason why the PCT device according to the present invention provides with the excellent effects, this is merely one example of the possible reasons inferred by the present inventors, and it seems that a reason different from the above described reason may be possible to explain the improvement of the performance of the PTC device as described in the present description, which improvement is achieved by using the nickel alloy filler according to the present invention. Therefore, whether the reason to provide with the superior effect is appropriate or not does not limit the technical scope of the present invention which is defined by the accompanied claims.

As mentioned above, the specific conductive filler referred to in the present invention essentially consists of nickel and other metal(s) as described above and also below (which means that the specific conductive filler may unavoidably contain other component(s) as an impurity, accordingly): in other words, such filler is a nickel alloy filler which brings about a rate of increase in electric resistance within a specific range (before a trip) and a rate of increase in electrical resistance within a specific range (after the trip) in aging change tests under the high temperature and dry atmospheres which will be described below the Examples. A particularly preferable Ni alloy filler is a filler of an alloy of nickel and at least one "other metal" which is baser than nickel.

Examples of such "other metal" include for example aluminum, manganese, chromium, cobalt and the like. A filler of an alloy of at least one of such "other metals" and nickel is used as the Ni alloy filler. Preferable examples of "other metal" or "the second metal" are cobalt, manganese and chromium, and an Ni—Co alloy filler is particularly preferable. Each of the components which constitutes such Ni alloy filler may entirely be of the above Ni alloy, and in another embodiment, each of the components which constitutes the Ni alloy filler may comprise a core formed from a material different from the Ni alloy (e.g. nickel) and a mass(es) of such Ni alloy around the core (e.g. a layer of the nickel alloy). Accordingly, in the present invention, at least a surface of the component which constitutes the conductive filler for example, a surface of a particle which constitutes the filler has the nickel alloy thereon.

As will be apparent from the above and below descriptions, the broadest conception of the present invention includes the use of the filler (e.g. the filler in the form of powder filler) which contains nickel and the above-described other metal(s) (e.g. cobalt) as the conductive filler of the polymer PTC element of the PTC device. Such filler may be referred to as "other metal-containing nickel filler" (e.g. "cobalt-containing nickel filler" or "cobalt-containing nickel powder"). In the present invention, it is preferable to use a nickel alloy powder obtained by a co-precipitation process which will be described later. However, according to the broadest conception of the present invention, the powder to be used as the conductive filler is not necessarily obtained by such process. If nickel contains other metal such as cobalt or the like, the effect achieved by the present invention is expected to be provided by such nickel although there may be a relative difference in the degrees of the effects. For example, very fine particles of other metal in a dispersed state may be present on the surface and/or the interior of the nickel particles. In other words, the components which constitute the powder (e.g. particles) may include relatively larger nickel particles which contain relatively smaller other metal particles.

There is no particular limitation in selection of the form of the above mentioned nickel alloy filler, in so far as the effect according to the present invention is provided. For example, the nickel alloy filler of the present invention may be in any of powder, particles, flake forms and any combination of these forms. More specifically, the component which constitutes the filler may be in any form of globular, columnar, disc, needle, scale and other shapes. These various forms of the components are collectively called "particles". Further, the surfaces of such particles may be raised and/or recessed, and thus the particles may have irregularities on their surfaces. Preferably, in the PTC element, such filler is in a secondary agglomeration state of such particles as primary particles (e.g. in the form of a bunch of grapes, a dendrite, a sphere or a filament). In the production of the PTC device, preferably, the particles are in the form of the secondary agglomerations (for example, the average size of the secondary particles is about 20 μm in a particle size distribution measured by using laser which will be described below) when added to a polymer.

The size of "the particles" which constitute the filler is not specifically limited, so long as the above mentioned specific conductive filler is provided. The average particle size of the filler is preferably 5 to 50 μm, more preferably 10 to 30 μm, for example, about 20 μm. The average particle size herein referred to means an average particle size of a particle size distribution which is measured according to a method based on the laser diffraction scattering method as the measuring principle, that is, a so-called average particle size, and which is measured according to the procedure of JIS R-1629. In concrete, the average particle size means a size which is measured with a particle size distribution-measuring apparatus which uses a laser light diffraction-scattering as described below in the Examples.

Accordingly, in one of preferred PTC devices according to the present invention, the Ni alloy filler such as an Ni—Co alloy filler is in the form of particles of which average particle size is in the range of 5 to 50 μm.

The proportion of "other metal" in the Ni alloy filler is not specifically limited, provided that the effect of the above specified conductive filler is provided. However, the proportion of other metal is preferably 2 to 20 wt. % (or mass %), more preferably 3 to 18 wt. % (or mass %), particularly 3 to 11 wt. % (or mass %), for example 4 to 6 wt. % (or mass %), based on the total weight of the filler. When the proportion of "other metal" is smaller than 2 wt. %, the effect of "other metal" may be insufficient. On the contrary, when the proportion of "other metal" is larger than 20 wt. %, the effect of "other metal" may be not so remarkable, and it may be disadvantageous in view of its cost.

Accordingly, in one of the preferred embodiments of the PTC device according to the present invention, the Ni alloy filler comprises "other metal", for example, cobalt, in an amount of 2 to 20 wt. %, preferably 3 to 18 wt. %, more preferably 3 to 15 wt. %, for example, 4 to 6 wt. % or 8 to 12 wt. %, particularly 5 wt. % or 10 wt. %.

The Ni alloy filler may be produced by any of appropriate known processes, so long as the above specified conductive filler can be provided. According to one of the methods, an aqueous solution containing nickel ions together with the ions of "other metal" is prepared; then, the metals are concurrently precipitated by the reduction of those ions; then, the resulting coprecipitates are separated by filtration and dried; and if needed, the dried coprecipitates are calcined to obtain a filler. In case of the production of an Ni alloy filler in which an Ni alloy is present around a core, nickel and "other metal" are chemically (or electrochemically) precipitated, plated or deposited around a metal particle (e.g. a nickel particle) constituting the core. In one example thereof, powder (e.g. nickel powder) as cores is dispersed in an aqueous solution containing nickel ions and ions of "other metal" concurrently, followed by reducing those ions, so that the nickel and "other metal" are precipitated around the cores; and then, the resulted particles are separated by the filtration and dried, and if needed, calcined, to thereby obtain a filler.

More specifically, the following may be exemplified: A reducing agent is added to an aqueous solution containing a hydroxide of other metal such as cobalt and a hydroxide of nickel to thereby co-precipitate particles containing cobalt and nickel; or otherwise, firstly, nickel particles are precipitated, and then, cobalt and nickel are co-precipitated on the surfaces of the precipitated particles. In the former process, since the Ni alloy filler can be obtained by co-precipitating nickel and other metal such as cobalt, other metal (e.g. cobalt) are almost uniformly present throughout a whole of the particle. In the latter process, nickel and other metal (e.g. cobalt) are almost uniformly present around the nickel particle.

In the case where the nickel alloy filler in the form of the particles is obtained by firstly precipitating nickel, and then co-precipitating nickel and other metal (e.g. cobalt) around the precipitated nickel particles, the firstly precipitated nickel particles are not so dense, and therefore, other metal (e.g. cobalt) is present throughout a whole of the finally obtained particles. In such particles, the proportion of the existing other metal (e.g. cobalt) increases more and more toward the surfaces of the particles, and such particles may be referred to as a kind of graded alloy particles. In either of the cases, it is preferable that cobalt is contained in the surface portions of the finally obtained particles or in the proximity thereof in an amount of 3 to 40 wt. % (or mass %), preferably 8 to 30 wt. % (or mass %), more preferably 8 to 12 wt. % (or mass %) or 18 to 25 wt. % (or mass %), for example, 9 to 12 wt. % (or mass %) or 18 to 23 wt. % (or mass %), particularly 10 wt. % (or mass %) or 20 wt. % (or mass %).

The conditions for producing the filler may be optionally selected according to an intended nickel alloy filler containing other metal. In the case where the alloy particles are precipitated as described above, the precipitated particles may be heated and calcined if required.

A reducing agent in an amount sufficient to reduce intended metal ions (i.e., an amount exceeding a stoichiometric amount) is used upon the precipitation, so that substantially all of dissolved metal ions can be reduced. When a sufficient amount of the reducing agent is used, the proportion of the dissolved meal ions corresponds to the proportion of nickel and other metal in the nickel alloy.

In this regard, US-A (Published Application) No. 2005-072270 and WO2005/023461 laid open after the priority date which the present application claims disclose the powder which comprises nickel particles containing cobalt as other metal, and also the processes for producing such powder; and such powder can be used in the PTC device according to the present invention. The disclosures of these patent publications are incorporated into the present description by reference to those patent publications, and those disclosures constitute a part of the disclosure of the present description.

There is other process for producing the filler other than the above process for obtaining the Ni alloy filler by co-precipitating nickel and other metal (e.g. cobalt) as described above. Such process comprises the steps of melting and mixing nickel powder and other metal powder, cooling the resulted mixture, and grinding the mixture to obtain fine particles as the Ni alloy filler. Preferably, this process is carried out under an atmosphere shutting off oxygen.

The polymer material to be used for the polymer PTC device according to the present invention brings about the foregoing PTC characteristics, and it may be a known polymer material which is used for the conventional polymer PTC devices. Such polymer material is a thermoplastic crystalline polymer such as a polyethylene, an ethylene copolymer, a fluorine-containing polymer, a polyamide, a polyester or the like. Each or any combination of those materials may be used.

More specifically, a high density polyethylene, a low density polyethylene or the like may be used as the polyethylene; an ethylene-ethyl acrylate copolymer, an ethylene-butyl acrylate copolymer, an ethylene-vinyl acetate copolymer, an ethylene-polyoxymethylene copolymer or the like may be used as the ethylene copolymer; a polyvinylidene fluoride, a copolymer of ethylene difluoride, ethylene tetrafluoride and propylene hexafluoride, or the like may be used as the fluorine-containing polymer; a nylon 6, nylon 66, nylon 12 or the like may be used as the polyamide; and a polybutylene terephthalate (PBT), polyethylene terephthalate (PET) or the like may be used as the polyester.

In the polymer PTC element according to the polymer PTC device according to the present invention, the proportions of the polymer material and the conductive filler may be optionally appropriately selected in so far as the foregoing effect of the specific conductive filler can be provided. For example, 65 to 85 wt. %, preferably 70 to 80 wt. % of the conductive filler is included based on the total weight of the polymer and the filler.

The polymer PTC element of the polymer PTC device according to the present invention may be manufactured by any of the known processes. For example, a mixture obtained as a PTC composition by kneading a polymer material and a conductive filler is subjected to extrusion to obtain a PTC element in the form of a plate or a sheet.

The "polymer PTC element" referred to in the present invention means a shaped material which contains "the conductive filler" and "the polymer material" as described above, and generally has a lay-like shape.

"The polymer PTC element" can be produced from "the conductive filler" and "the polymer material" as described above by employing any of the processes which are generally known for producing the polymer PTC elements. Examples of such process include extrusion, molding, injection molding, etc.

The metal electrode for use in the polymer PTC device according to the present invention may be formed of any of metal materials which are known to be used in the known polymer PTC elements. The metal electrode may be, for example, in the form of a plate or a foil. There is no particular limitation in selection of the metal electrode so long as a PTC device intended by the present invention can be obtained. Specifically, a surface-roughened metal plate, surface-roughened metal foil, etc. can be used as the metal electrode. When a metal electrode of which surface is roughened is used, its roughened surface is brought into contact with the PTC element. For example, a commercially available electrodeposition copper foil or a nickel-plated electrodeposition copper foil can be used.

Such "metal electrode" is disposed on at least one of, preferably both of the main opposing surfaces of the PTC element. The metal electrode may be disposed in the same manner as in the conventional production process for the PTC elements. For example, a metal electrode may be thermocompression-bonded on a plate-like or sheet-like PTC element obtained by the extrusion. In other embodiment, the mixture of the polymer material and the conductive filler may be extruded onto a metal electrode, and then, if needed, the resulted extrudate with the metal electrode may be cut into smaller PTC devices.

In addition to the foregoing first aspect, the present invention provides an electric apparatus such as an electric or electronic equipment in which the PTC device according to the present invention as described above or below is incorporated. "The electric apparatus" herein referred to is not limited, in so far as the PTC device is incorporated thereinto. Examples of such electric apparatus include a cellular telephone, a personal computer, a digital camera, a DVD apparatus, a game machine, a variety of displays, an audio equipment, an electric equipment and an electronic equipment for automobiles, and an electric part mounted on these electric apparatuses, such as an electric circuit, a battery, a capacitor, a semiconductor protection component, etc.

The present invention further provides a nickel alloy filler, particularly a nickel-cobalt alloy filler as the specific conductive filler which is used in the PTC device according to the present invention as described above or below by using such nickel alloy, and also provides a method for suppressing the aging changes of the characteristics of the PTC device particularly under a high temperature and dry atmosphere, in particular, a method for suppressing an increase in resistance of the PTC device by using such nickel alloy filler. Additionally, the present invention provides a conductive polymer composition which comprises the polymer material and the nickel alloy filler as the conductive filler, for use in the preparation of a PTC element of the PTC device according to the present invention. Furthermore, the present invention provides a PTC element formed by, for example, the extrusion of such conductive polymer composition.

In any of the above according to the present invention, the polymer material and the metal electrode which are to be used, the process for producing the PTC element, the process for producing the PTC device, and the various characteristics of the electric apparatus comprising the PTC device may be basically the same as in the case of the conventionally known polymer PTC devices, except that the PTC device of the present invention comprises the foregoing nickel alloy filler as the specific conductive filler.

In the PTC device according to the present invention, the PTC element may additionally contain a different conductive filler, for example, a conventional conductive filler such as carbon black, etc., if needed.

EXAMPLES

The present invention will be described in more detail by way of Examples thereof, which are merely illustrative for some embodiments and should not be construed as limiting the scope of the present invention in any way.

As described below, a PTC device was produced, using a nickel-cobalt alloy filler as a conductive filler, a polyethylene as a polymer material, and a nickel foil as a metal electrode.

(1) Preparation of Electrically Conductive Filler

An aqueous sodium hydroxide solution containing tartaric acid (1,125 ml) was heated to 85° C. while stirring, to which an aqueous nickel chloride solution (containing 19.5 g in terms of nickel) was added, followed by the addition of a sufficient amount of hydrazine (89.1 g) as a reducing agent. Thus, Ni metal powder was reduction precipitated.

Next, an aqueous cobalt chloride solution (containing 3.9 g of metal cobalt) and an aqueous nickel chloride solution (containing 15.6 g of metal nickel) were prepared. These aqueous solutions were mixed, and the resulted mixture was added to the above described aqueous solution containing the Ni metal powder, so that nickel and cobalt were further reduced and precipitated around the previously precipitated Ni powder, by using a sufficient amount of a reducing agent. Thus, an aqueous solution containing an Ni—Co alloy powder was obtained.

The resultant solution was filtered to separate the powder, which was washed with water and dried at 80° C. in the air to obtain an electrically conductive filler. The above mentioned steps were repeated several times to obtain powder as the conductive filler used in the Examples (referred to as "a filler of Example"). The particles of the resultant powder contained 10 wt. % of cobalt based on the weight of a whole of the particles, and the surface portions of the particles contained 20 wt. % of cobalt. Separately, as a comparative example, a polymer PTC device was produced in the same manner, except that a nickel filler (trade name: Inco 255 manufactured by INCO, referred to as "a filler of Comparative Example") was used as a conductive filler.

The physical properties of the used fillers are shown in Table 1 below:

TABLE 1

| | | Filler of Example | Filler of Comparative Example |
|---|---|---|---|
| Bulk density | (g/ml) | 1.00 | 0.56 |
| Tap density | (g/ml) | 1.54 | 1.32 |
| Particle size (D50) | (μm) | 20.9 | 21.3 |

The bulk density of each filler was measured according to the procedure of JIS R-1628.

The tap density of each filler was measured using a 25 ml graduated cylinder and a vibration specific gravity meter (KRS-409 manufactured by Kuramochi Kagaku Kiki Seisakusho) under the following conditions:

Tap height: 20 mm

Number of tapping: 500 times.

The particle size (D50) is an average particle size which was measured according to the procedure of JIS R-1629, using a particle size distribution measuring apparatus (Microtrack HRA manufactured by Nikkiso).

(2) Polymer Material

A commercially available high density polyethylene (density: 0.957 to 0.964 g/ml, melt index: 0.23 to 0.30 g/10 mins., and melting point: 135±3° C.) was used.

(3) Metal Electrode

A nickel metal foil (an electrolytic nickel foil with a thickness of about 25 μm, manufactured by Fukuda Kinzokuhakufun Kogyo) was used.

(4) Production of PTC Device (4-1)

A powdery polymer material and a conductive filler were weighed in a predetermined ratio as indicated in Table 2 below, and they were mixed with a kitchen blender (MILL MIXER MODEL FM-50 manufactured by San K.K.) for 30 seconds to obtain a blended mixture.

TABLE 2

| | Conductive filler (vol. %/wt. %) | Polymer material (vol. %/wt. %) | Density of blended mixture (g/ml) |
|---|---|---|---|
| Example 1 | 30.0/76.4 | the balance | 3.49 |
| Comparative Example 1 | 43.0/84.6 | the balance | 4.52 |
| Comparative Example 2 | 30.0/76.4 | the balance | 3.49 |

(4-2) Preparation of PTC Composition

Then, the blended mixture (45 ml) obtained in the step (4-1) was charged in a mil (Laboplastmil Model 50C150, Blade R60B, manufactured by Toyo Seiki Seisakusho), and was knead at 160° C. and 60 rpm for 15 minutes to obtain a PTC composition.

(4-3) Production of PTC Element

A sandwich or stacking structure of an iron plate/a Teflon sheet/a thickness adjusting spacer (made of SUS with thickness of 0.5 mm)+the PTC composition/a Teflon sheet/an iron plate was prepared while using the PTC composition obtained in the step (4-2). The sandwich structure was preliminarily pressed at a temperature of 180 to 200° C. under a pressure of 0.52 MPa for 3 minutes using a thermo-compression press (a hydraulic molding machine model T-1, manufactured by Toho Press Seisakusho), and was then substantially pressed under a pressure of 5.2 MPa for 4 minutes. After that, the pressed sandwiched structure was pressed for 4 minutes under a pressure of 5.2 MPa using a cooling press (a hydraulic molding machine T-1, manufactured by Toho Press Seisakusho) through which water set at 22° C. by a chiller was circulated. Thus, a sheet-like polymer PTC element (i.e. an original plate for PTC element) was obtained.

(4-4)

Next, the original plate for PTC element prepared in the step (4-3) and metal electrodes were used to prepare a sandwich (or stacking) structure of an iron plate/a Teflon sheet/silicone rubber/a Teflon sheet/a metal electrode/a thickness adjusting spacer (made of SUS with a thickness of 0.5 mm)+the original plate for PTC element/a metal electrode/a Teflon sheet/silicone rubber/a Teflon sheet/an iron plate. The resulted sandwich structure was substantially pressed at a temperature of 170 to 210° C. under a pressure of 50 kg/cm$^2$ (indicated on an attached pressure gauge) for 5 minutes, using the above mentioned thermo-compression press, and then was pressed under a pressure of 50 kg/cm$^2$ for 4 minutes, using the above cooling press through which water set at 22° C. by the chiller was circulated, to thereby bond the metal electrodes onto both main surfaces of the polymer PTC element (i.e. the plate stock for PTC element) by thermo-compressing bonding, so that an original plate (plaque) stock for a polymer device (an aggregate of PTC devices before being cut) was obtained.

(4-5)

The original plate (plaque) for polymer PTC device obtained in the step (4-4) was exposed to γ-ray radiation of 500 kGy, and then was punched out into discs with a ¼ inch diameter, using a hand operating punch, so that polymer PTC devices as tested pieces were obtained.

(4-6) Production of PTC Device

Pure Ni lead pieces each having a thickness of 0.125 mm, a hardness of ¼H and a size of 3 mm×15.5 mm were soldered onto both sides of the punched out disc-shaped test piece with a diameter of ¼ inch obtained in the step (4-5), whereby a PTC device was obtained as a test sample in the form of a strap as a whole. Solder paste (M705-444C manufactured by Senjukinzoku Kogyo) (about 2.0 mg) was used on each side of the test piece, and a reflow oven (Model TCW-118N manufactured by Nippon Abionix, auxiliary heater temperature: 360° C., controlled preheating temperature: 250° C., controlled reflow temperature (1): 240° C., controlled reflow temperature (2): 370° C., and belt speed: 370 mm/min.) was used for the above soldering under a nitrogen atmosphere. After that, the test sample was stored in a temperature controllable oven (Mddel SSP-47ML-A, manufactured by Kato) for 6 cycles, in which, the test sample was subjected to a cycling test wherein in one cycle, the test piece was maintained at −40° C. for one hour, then the temperature was increased to 80° C. at a rate of 2° C./minute, and then the test piece was maintained at 80° C. for one hour, and such cycle was repeated six times. Thus, the resistance of the test sample of PTC device was stabilized.

(5) Measurement of Initial Resistance

The resistance of the resultant test sample was measured. This resistance was regarded as an initial resistance value of the PTC device. A milli-ohmmeter (4263 A manufactured by HEWLETT PACKARD) was used to measure the initial resistance of the test sample and resistances of the PTC devices under various conditions as described below. The results are shown in Table 3.

TABLE 3

| | Initial Resistance of PTC Device (Ω) | |
|---|---|---|
| | Average Value (Ω) | Standard Deviation |
| Example 1 | 0.00316 | 0.000316 |
| Comparative Example 1 | 0.00374 | 0.000476 |
| Comparative Example 2 | 0.0115 | 0.00246 |

It was known from the above results that the PTC device according to the present invention (Example 1) showed a resistance equivalent to that of a PTC device comprising 85 wt. % of a nickel filler (Comparative Example 1), in spite of the smaller amount of the conductive filler. Accordingly, the use of the nickel alloy filler of the present invention makes it possible to obtain a low resistance with the addition of a smaller amount of the filler.

(6) Confirmation of PTC Characteristics

Figure 2:
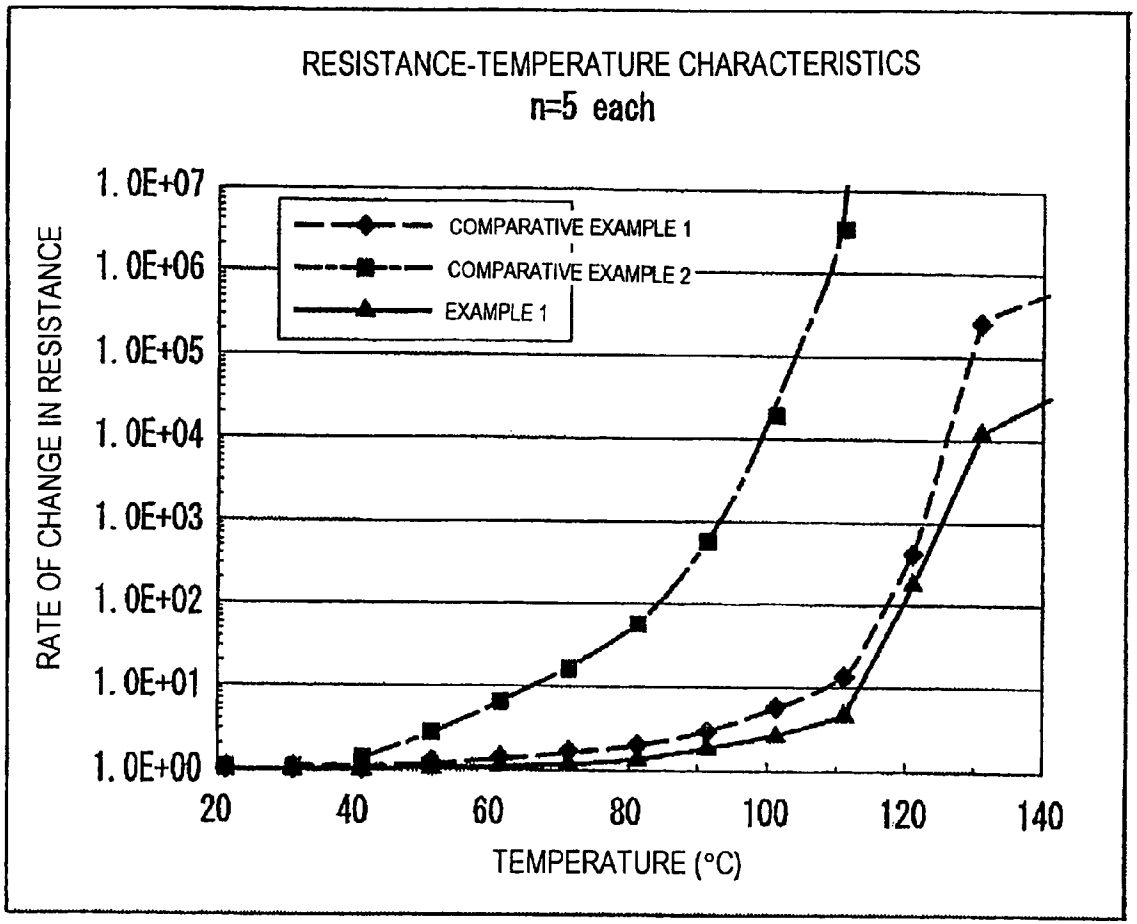
FIG. 2 shows a graph illustrating the PTC characteristics of PTC devices produced as Example 1 and Comparative Examples 1 and 2.

Next, each five test samples of Example 1 and Comparative Examples 1 and 2 were subjected to measurement of resistance-temperature characteristics. The temperature of the measurement was within a range of 20 to 150° C., and the ambient humidity around the test samples was set at 60% or lower. The ambient temperature around the test samples was increased by 10° C. each, followed by holding such temperature for 10 minutes and then, the resistance of each PTC device was measured. The ratio of the resistance measured at each temperature to the resistance measured at the initial temperature (21° C.) (i.e. the rate of change in resistance) is shown in FIG. 2 and Table 4.

TABLE 4

| Temperature (° C.) | Example 1 Rate of change in resistance (-) | Comparative Example 1 Rate of change in resistance (-) | Comparative Example 2 Rate of change in resistance (-) |
|---|---|---|---|
| 21 | 1.00 | 1.00 | 1.00 |
| 31 | 1.04 | 1.02 | 1.03 |
| 41 | 1.09 | 1.12 | 1.36 |
| 51 | 1.17 | 1.27 | 2.93 |
| 61 | 1.33 | 1.42 | 6.52 |
| 71 | 1.39 | 1.71 | 16.9 |
| 81 | 1.59 | 2.11 | 58.3 |
| 91 | 1.99 | 3.26 | 591 |
| 101 | 2.74 | 5.77 | 1.83E+4 ($1.83 \times 10^4$) |
| 111 | 4.89 | 13.8 | 3.25E+6 ($3.25 \times 10^6$) |
| 121 | 1.92E+2 ($1.92 \times 10^2$) | 389 | Impossible to measure |
| 131 | 1.39E+4 ($1.39 \times 10^4$) | 2.47.E+5 ($2.47 \times 10^5$) | Impossible to measure |
| 141 | 3.83E+4 ($3.83 \times 10^4$) | 5.26E+5 ($5.26 \times 10^5$) | Impossible to measure |
| 151 | 2.71E+4 ($2.71 \times 10^4$) | 1.05E+6 ($1.05 \times 10^6$) | Impossible to measure |

The wording "impossible to measure" means that measurement was impossible because of the high resistance.

From the above results, the following is seen: The PTC devices of Example 1 and Comparative Example 1 had threshold temperatures within the range of about 110 to about 130° C., and in either of these PTC devices, a resistance measured at a temperature above the upper limit of such range was about $10^3$ or more times higher than the resistance measured at a temperature below the lower limit of such range; and the PTC device of Comparative Example 2 had a threshold temperature within the range of about 90 to about 110° C., and a resistance measured at a temperature above the upper limit of such range was about $10^3$ times higher than a resistance value measured at a temperature below the lower limit of such range. Accordingly, it is apparent that all of the samples had a switching function.

(7) Measurement of Change in Resistance with Time Under High Temperature and Dry Atmosphere Each 30 test samples were stored in a temperature controllable oven (DK600 manufactured by Yamato) under a high temperature and dry atmosphere controlled (temperature of 85° C.±3° C. and a relative humidity of not higher than 10%). Each 10 test samples were taken out of the oven, respectively, after each of 280 hours, 490 hours and 1,060 hours passed, and were left to stand at a room temperature for one hour. After that, their resistances were measured with the milliohmmeter. After the measurement, a stabilized DC power supply (PAD35-60L manufactured by Kikusui Denshi Kogyo) was used to apply a voltage to each of the test samples for 30 seconds under the condition of 12V/50 A, so as to thereby trip each device of the test samples. After that, the device was left to stand at a room temperature for one hour, and then was measured in resistance with the milli-ohommeter. The results of the measurements are shown in Table 5 below and FIG. 3. In Table 5, a ratio of a resistance measured after each period of time passed to a resistance at zero hour, namely an increasing rate of electric resistance is shown.

TABLE 5

| | | Increasing Rate of Electric Resistance | | | |
|---|---|---|---|---|---|
| | | 0 hr. | 280 hrs. | 490 hrs. | 1060 hrs. |
| Comparative Example 1 | (before trip) | 1.00 | 1.35 | 1.72 | 3.11 |
| Comparative Example 2 | (before trip) | 1.00 | 2.63 | 5.96 | 2.69E+3 |
| Example 1 | (before trip) | 1.00 | 1.13 | 1.06 | 1.17 |
| Comparative Example 1 | (after trip) | — | 1.61 | 3.70 | 7.37 |
| Comparative Example 2 | (after trip) | — | 3.90 | 8.45 | 6.00E+3 |
| Example 1 | (after trip) | — | 1.40 | 1.48 | 1.75 |

In comparison between Example 1 and Comparative Examples, it is seen that the resistance-increasing rates of the devices of Comparative Examples (before trip) had tendencies to appreciably increase with the passage of time, while the device of Example 1 showed a far lower rate of change in resistance. When each of the devices was tripped after each period of time passed, the devices of Comparative Examples showed tendencies to increase in the resistance-increasing rate (after the trip) with the passage of time, while the device of Example 1 was so good as appreciably lower in the resistance-increasing rate after the trip, as compared with Comparative Examples.

In this regard, the above mentioned wording of "the electric resistance-increasing rate (before trip) within a specific range and the electric resistance-increasing rate (after trip) within a specific range" which are induced by the conductive filler of the present invention means the following: that is, based on the results of the above test, the increasing rate of the electric resistance of the device after 1,000 hours passed, as the increasing rate of the electric resistance (before the trip) (which corresponds to a rate of the resistance measured after 1,000 hours passed/the initial resistance measured before the test (zero hour)) is not larger than 1.8, preferably not larger than 1.5 (not larger than about 1.2 in this Example); and the increasing rate of the electric resistance (after the trip) of the device measured after 1,000 hours passed to the initial resistance which corresponds to a rate of the resistance measured after 1,000 hours and then the trip/the initial resistance measured before the test (zero hour)) is not larger than 3.0, preferably not larger than 2.0 (not larger than about 1.8 in this Example). In other words, the conductive filler used in the polymer PTC device according to the present invention brings about an electric resistance-increasing rate (before trip) of not larger than 1.8, preferably not larger than 1.5 after 1,000 hours have passed, and also brings about an electric resistance-increasing rate after the trip of not larger than 3.0, preferably not larger than 2.0 after 1,000 hours have passed.

The electric resistance-increasing rate of not larger than 1.8, preferably not larger than 1.5 measured after 1,000 hours have passed (before the trip), and the electric resistance-increasing rate (after the trip) of not larger than 3.0, preferably not larger than 2.0, both rates of which are obtained in the measurement of the aging change in resistance under the above-mentioned high temperature and dry atmosphere, are the electric resistance-increasing rate of the PTC device according to the present invention within the specific range (before the trip) and the electric resistance-increasing rate of the PTC device according to the present invention within the specific range (after the trip).

(8) Measurement of Change in Resistance with Time Under Room Temperature and Normal Humidity Atmosphere Each 30 test samples of PTC devices were stored in a room at a temperature controlled to 23±5° C. and at a relative humidity controlled to 20 to 60% (equivalent to a normal humidity without any control), and subjected to the same test as that conducted in the above step (7). In this regard, the number of the samples used was 20, and each 5 samples were picked up, respectively, after each of 280 hours, 490 hours and 1,060 hours passed, so as to measure the resistances thereof. The resistances of the samples were measured after the trip in the same manner. The results of the measurements are shown in Table 6 below and FIG. 4. Similar to Table 5, Table 6 shows the ratio of a resistance measured after each period of time passed to a resistance measured at zero hour.

TABLE 6

| Electric Resistance-Increasing rate | | | | | |
|---|---|---|---|---|---|
| | | 0 hr. | 280 hrs. | 490 hrs. | 1060 hrs. |
| Comparative Example 1 | (before trip) | 1.00 | 1.00 | 0.945 | 1.12 |
| Comparative Example 2 | (before trip) | 1.00 | 0.962 | 0.973 | 1.24 |
| Example 1 | (before trip) | 1.00 | 0.987 | 1.02 | 1.09 |
| Comparative Example 1 | (after trip) | — | 1.30 | 1.31 | 1.64 |
| Comparative Example 2 | (after trip) | — | 2.34 | 2.71 | 4.27 |
| Example 1 | (after trip) | — | 1.25 | 1.20 | 1.18 |

There was observed not so significant difference in electric resistance-increasing rate before the trip among the PTC devices. However, there were observed apparent differences in electric resistance-increasing rate after the trip among them. Especially, the PTC device of Comparative Example 2 showed an appreciably higher resistance-increasing rate as compared with that of the PTC device of Example 1, and also it is seen that the increasing rate itself of the PTC device of Comparative Example 2 became larger with time. On the other hand, the PTC device of Example 1 showed little aging with time in increasing rate.

Separately, the samples were subjected to the same test as the above: that is, the samples were stored for about 3,700 hours under the same atmosphere, and the resistance of each five samples were measured before the trip, and then, the resistance (after the trip) of the samples were measured after the trip, and the ratios of thus measured resistances to the resistance measured at a storing time of zero were determined. The results are shown in Table 7. The results of Table 7 show similar tendencies to those of Table 6.

TABLE 7

| | | 0 hr. | 3,700 hrs. |
|---|---|---|---|
| Comparative Example 1 | (before trip) | 1.00 | 0.854 |
| Comparative Example 2 | (before trip) | 1.00 | 1.01 |
| Example 1 | (before trip) | 1.00 | 0.945 |
| Comparative Example 1 | (after trip) | — | 2.57 |
| Comparative Example 2 | (after trip) | — | 16.4 |
| Example 1 | (after trip) | — | 1.20 |

(9) Measurements of Change in Resistance with Time Under High Temperature and Dry Atmosphere and Under High Temperature and High Humidity Atmosphere The PTC devices were stored in a temperature controllable oven (temperature of 85° C.±3° C. and a humidity of not higher than 10%). On the other hand, other PTC devices were stored in a temperature and humidity controllable oven (temperature of 85° C.±3° C. and a relative humidity of 85%) (Humidic Chamber IG43M manufactured by Yamato Kagakusha).

In this regard, a PTC device of the present invention (referred to as a device of Example 2) tested herein is different from the device of Example 1 in that the device of Example 2 contained 75.4 wt. % of the conductive filler. A device of Comparative Example 3 is different from the device of Comparative Example 1 in that the device of Comparative Example 3 contained 80.5 wt. % of the conductive filler. As the leads, 22 AWG tin plated copper leads were used, which were disposed on both sides of each device, and such device with the leads was dipped in flux (Sparcleflux ESR-250 manufactured by Senjukinzoku Kogyo) for 3 seconds, and then was dipped in an eutectic solder bath of tin and lead in the ratio 6:4, maintained at 220° C. for 10 seconds for soldering. The resultant sample device was stabilized in resistance in the same manner as the above, using a temperature controllable oven (Model SSP-47mL-A, manufactured by Kato).

The resultant samples were tested for finding changes in resistance with time. In each of the tests, each 5 samples of Example 2 and Comparative Example 3 were used, and their resistances were measured, respectively, after each of 21 hours, 188 hours, 356 hours and 600 hours passed. The resistances of the devices were measured with the milli-ohmmeter after the devices were left to stand at a room temperature for one hour after the removal from the oven.

After the measurement of the resistance of the device which were stored for 600 hours, a voltage was applied to the device for 30 seconds under the condition of 12V/50 A, using the stabilized DC power supply, so as to trip the device in the same manner as described above. After that, the device was left to stand at a room temperature for one hour, and then, the resistance thereof was measured with the milli-ohmmeter.

Figure 5:
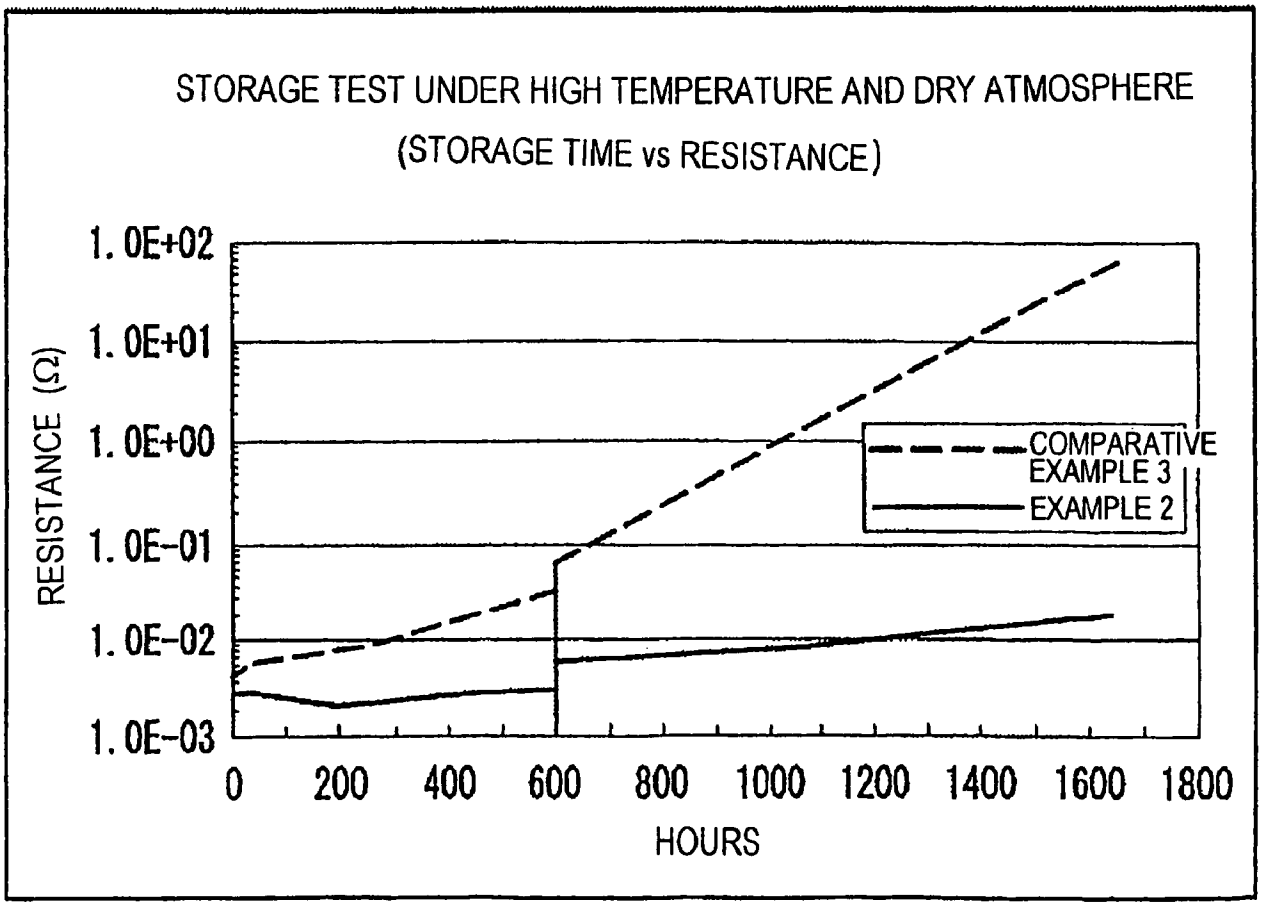
FIG. 5 shows a graph indicating resistance changes of the PTC devices as Example 2 and Comparative Example 3 which were stored under a high temperature and dry atmosphere, wherein each of the PTC devices was tripped by the application of a voltage of 12 Vdc for 30 seconds after 600 hours, and then, the PTC devices were again stored under a dried atmosphere at 85° C. to measure the resistances thereof.

After that, the same test sample was again returned to the oven and stored for 1,041 hours (1,641 hours in accumulative totals), followed by taking out of the oven, and then, the sample was left to stand at a room temperature for one hour. After that, the final resistance thereof was measured. The results are shown in Tables 8 and 9 and FIGS. 5 and 6. The graphs shown in FIGS. 5 and 6 were discontinuous before or after 600 hours passed, because of the influence of the trip.

TABLE 8

| Under High Temperature and Dry Atmosphere Condition | | |
|---|---|---|
| Time | Resistance (Ω) | |
| (hours) | Example 2 | Comparative Example 3 |
| 0 | 0.00272 | 0.00413 |
| 21 | 0.00287 | 0.00539 |
| 188 | 0.00216 | 0.00743 |
| 356 | 0.00268 | 0.0120 |
| 600 | 0.00311 | 0.0327 |
| 601 | 0.00552 | 0.0545 |
| 946 | 0.00736 | 0.580 |
| 1,642 | 0.0169 | 61.5 |

TABLE 9

| Under High Temperature and High Humidity Atmosphere Condition | | |
|---|---|---|
| Time | Resistance (Ω) | |
| (hours) | Example 2 | Comparative Example 3 |
| 0 | 0.00293 | 0.00475 |
| 21 | 0.00304 | 0.00542 |
| 188 | 0.00214 | 0.00546 |
| 356 | 0.00250 | 0.00701 |
| 600 | 0.00280 | 0.00798 |
| 601 | 0.00391 | 0.0106 |
| 1,642 | 0.00362 | 0.0126 |

From the above results, it is seen that there was not observed a large difference in change of resistance between the device of Example 2 and the device of Comparative Example 3 which were both stored under the high temperature and high humidity atmosphere of 85° C. and a relative humidity of 85%, but it is seen that there was observed a large difference in change of resistance between the device of Example 2 and the device of Comparative Example 3 which were both stored under the high temperature and dry atmosphere. It is seen that, when the device was tripped during the storage test, the change in resistance was accelerated. In other words, it is seen that the storage tests under the above high temperature and dry atmosphere are effective as one of the means for evaluating the qualities of polymer PTC devices in which metal fillers such as nickel fillers or nickel alloy fillers are used.

(10) Trip Cycle Test

The resistances of four device samples of Example 2 were measured at a room temperature, using the milli-ohmmeter. After that, these samples were set on a trip cycle testing machine which uses a power supply MODEL PAD 35-60L manufactured by Kikusui Denshi. The voltage was set at 12.0 Vdc, and the test current was set at 20 A.

A 20 A current is allowed to pass through each sample for 6 seconds, during which each sample is tripped. When the sample is tripped, the applied current is largely decreased and is substantially shut off, and a voltage close to 12 Vds as the set value is applied across both ends of the sample.

After the completion of the apply time of 6 seconds, the application of the current and voltage is stopped, and then, no application state is continued for 54 seconds. Such ON/OFF operation of the current and voltage application is controlled by a sequencer, and this sequence is defined as one cycle, and 100 cycles of the trip sequences were conducted on each of the samples.

After the completion of a predetermined number of cycles, the sample was once removed from the testing machine. One hour after the completion of the predetermined number of cycles, the resistance of the sample was measured. After that, the sample was again set on the testing machine to continue the trip cycle test. In this regard, the predetermined numbers of cycles were determined as 1 cycle, 10 cycles, 50 cycles and 100 cycles. The results of the measured resistances are shown in Table 10.

TABLE 10

| | Resistance (Ω) Measured after Trip Cycles | | | | |
|---|---|---|---|---|---|
| | Before test | After 1 cycle | After 10 cycles | After 50 cycles | After 100 cycles |
| | 0.00240 | 0.00272 | 0.00345 | 0.00491 | 0.00761 |
| | 0.00199 | 0.00230 | 0.00315 | 0.00481 | 0.00696 |
| | 0.00234 | 0.00263 | 0.00318 | 0.00460 | 0.00694 |
| | 0.00230 | 0.00306 | 0.00405 | 0.00574 | 0.00874 |
| Average | 0.00226 | 0.00268 | 0.00346 | 0.00502 | 0.00756 |
| Standard deviation | 0.000158 | 0.000271 | 0.000361 | 0.000433 | 0.000731 |

From above results, it is seen that the devices of Example 2 had repeatable switching functions which were considered to be essential for polymer PTC devices, and that those devices showed very low resistances even after the completion of 100 cycles.

(11) Production of Another PTC Device of the Present Invention and Evaluation of the Same A conductive filler was prepared as a "filler of another Example" similarly to "(1) the preparation of a conductive filler" as described above.

Ni powder was reduction-precipitated from a solution in the same manner as in the (1). To this aqueous solution containing the Ni powder were added an aqueous cobalt chloride solution containing 1.95 g of metal cobalt and an aqueous nickel chloride solution containing 17.55 g of metal nickel so as to produce a mixture solution. A sufficient amount of a reducing agent was added to the resulted mixture solution to thereby reduce and precipitate nickel and cobalt around the previously precipitated Ni particles. Thus, a solution containing Ni—Co alloy powder was obtained. The solution was subjected to the post-treatment as similarly to the above description, so that the Ni—Co alloy powder was obtained as the "filler of another Example." Each of the particles thus obtained contained 5 wt. % of cobalt based on the weight of a whole of the particle, and the surface portion of the particle contained 10 wt. % of cobalt.

The physical properties of the resultant filler are shown below:

Bulk density: 0.96 g/ml

Tap density: 1.42 g/ml

Particle size (D50): 20.6 μm

A PTC device of the present invention was produced in the same manner as in Example 1, using the above powder, so as to obtain samples of Example 3. The samples of Example 3 were subjected to the same tests as those conducted as to the samples of Example 1. As a result, the following were confirmed as the samples of Example 3.

(a) The threshold temperature of those samples were in the range from about 110° C. to about 130° C., and the rate of change in measured resistance between before and after the trip was not smaller than $10^3$. The rates of change in resistance calculated from the results of the measured resistances are shown in Table 11.

It is noted that the initial resistance value was 0.003344Ω (standard deviation: 0.000342).

TABLE 11

| Temperature (° C.) | Rate of Change in Resistance (-) |
|---|---|
| 21 | 1 |
| 31 | 1.04 |
| 41 | 1.08 |
| 51 | 1.18 |

TABLE 11-continued

| Temperature (° C.) | Rate of Change in Resistance (-) |
|---|---|
| 61 | 1.35 |
| 71 | 1.42 |
| 81 | 1.65 |
| 91 | 2.12 |
| 101 | 3.01 |
| 111 | 5.54 |
| 121 | 2.13E+02 ($2.13 \times 10^2$) |
| 131 | 1.60E+04 ($1.60 \times 10^4$) |
| 141 | 4.52E+04 ($4.52 \times 10^4$) |
| 151 | 3.98E+04 ($3.98 \times 10^4$) |

From the above results, it is apparent that the devices of Example 3 had threshold temperatures within the range of about 110° C. to 130° C., and that the resistance measured at a temperature above the upper limit of this range was about $10^3$ times higher than that measured at a temperature below the lower limit of this range, and therefore that the devices of Example 3 had the switching functions.

Figure 3:
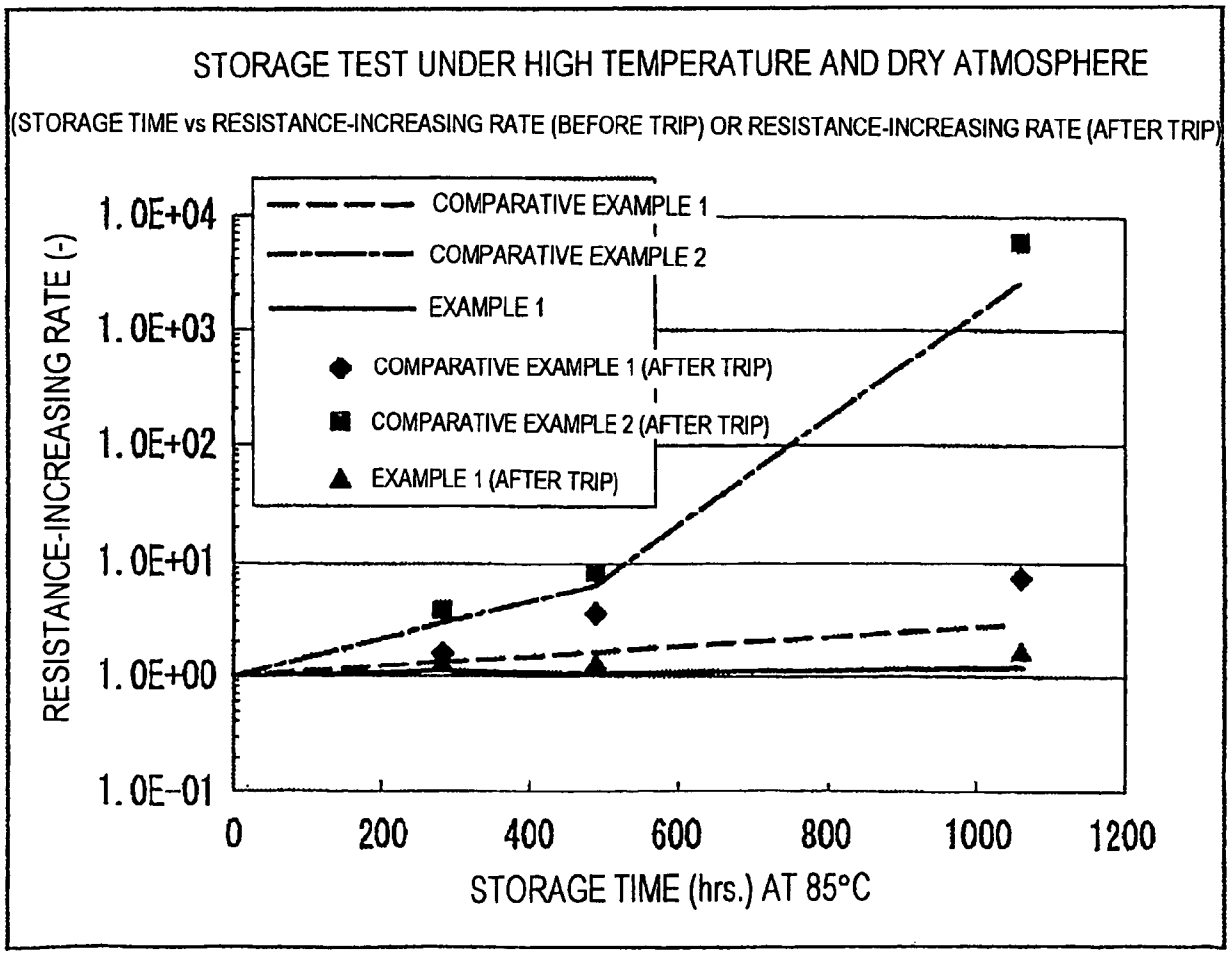
FIG. 3 shows a graph indicating resistance changes of the PTC devices as Example 1 and Comparative Examples 1 and 2 which have been stored under a high temperature and dry atmosphere.

(b) The changes in resistance of the devices with time under the high temperature and dry atmosphere showed substantially the same results as those shown in FIG. 3. The results are shown in Table 12.

TABLE 12

| Electric Resistance-Increasing Rate under Dry Atmosphere at 85° C. | | | | | |
|---|---|---|---|---|---|
| | | 0 hr. | 280 hrs. | 490 hrs. | 1060 hrs. |
| Example 3 | (Before trip) | 1 | 1.10 | 1.11 | 1.21 |
| Example 3 | (After trip) | — | 1.41 | 1.51 | 1.72 |

The electric resistance-increasing rates of the devices after 1,000 hours and before a trip (which corresponds to a ratio of a resistance measured after 1,000 hours passed/an initial resistance measured before the test (0 hour)) was about 1.2, and the electric resistance-increasing rates of the devices after the trip (which corresponds to a ratio of a resistance measured after 1,000 hours passed and after the trip/the initial resistance measured before the test (0 hour)) was about 1.7.

From the above results, it is seen that the PTC devices of Example 3 showed the lower resistance-increasing rates under the high temperature and dry atmospheres, as well as the PTC devices of Examples 1 and 2, and also it is seen that the PTC devices produced using the "filler of another Example" induced the electric resistance-increasing rate (before the trip) within the specific range and the electric resistance-increasing rate (after the trip) within the specific range, which are the characteristics of the PTC devices according to the present invention.

Figure 4:
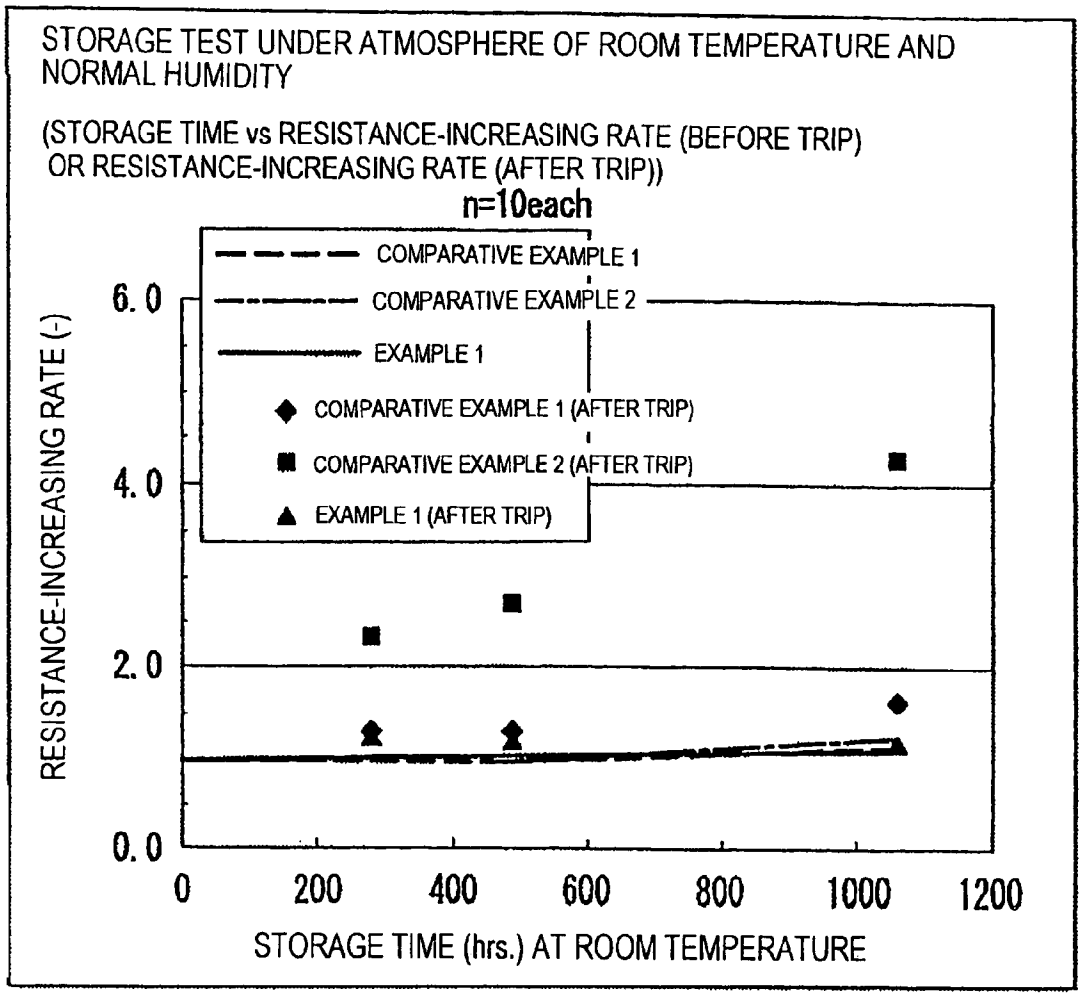
FIG. 4 shows a graph indicating resistance changes of the PTC devices as Example 1 and Comparative Examples 1 and 2 which have been stored under a room temperature and normal humidity atmosphere.

(c) The changes in resistance of the PTC devices with time under an atmosphere of room temperature and normal humidity showed substantially the same results as those shown in FIG. 4. The results are shown in Table 13.

TABLE 13

| Electric Resistance-Increasing Rate Under Condition of Room Temperature and Normal Humidity Atmosphere | | | | | |
|---|---|---|---|---|---|
| | | 0 hr. | 280 hrs. | 490 hrs. | 1060 hrs. |
| Example 3 | (Before trip) | 1 | 1.00 | 1.02 | 1.03 |

TABLE 13-continued

| Electric Resistance-Increasing Rate Under Condition of Room Temperature and Normal Humidity Atmosphere | | | | | |
|---|---|---|---|---|---|
| | | 0 hr. | 280 hrs. | 490 hrs. | 1060 hrs. |
| Example 3 | (After trip) | — | 1.22 | 1.24 | 1.26 |

Figure 6:
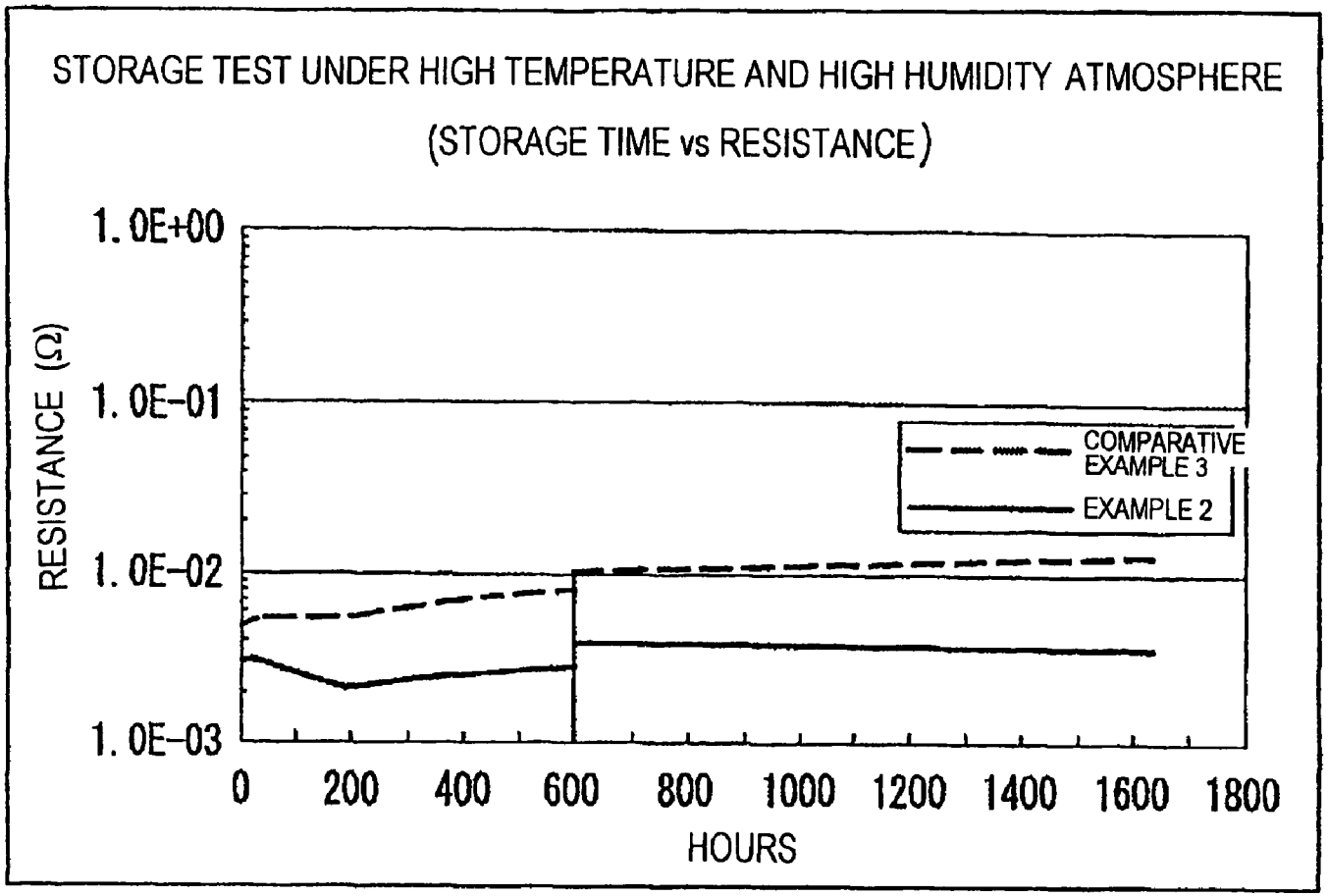
FIG. 6 shows a graph indicating resistance changes of the PTC devices as Example 2 and Comparative Example 3 which were stored under a high temperature and high humidity atmosphere, wherein each of the PTC devices was tripped by the application of a voltage of 12 Vdc for 30 seconds after 600 hours, and then, the PTC devices were again stored under an atmosphere at 85° C. and a high humidity to measure the resistances thereof.

In addition, the changes in resistance with time of the samples of Example 3 were measured under the high temperature and high humidity atmosphere in the same manner as in Example 2, and the results were substantially the same as those shown in FIG. 6. The resistance of these samples did not substantially increase until 600 hours passed, and the resistance of the samples slightly increased when the samples were tripped after 600 hours had passed (i.e. the resistance became about 1.24 times higher). After that, the measurement was continued for another 1,000 hours, which resulted in no further substantial increase in resistance. The results are shown in Table 14.

TABLE 14

| Resistance Measured under High Temperature and High Humidity Atmosphere Condition | |
|---|---|
| Time (hours) | Resistance (Ω) |
| 0 | 0.00322 |
| 21 | 0.00330 |
| 188 | 0.00294 |
| 356 | 0.00299 |
| 600 | 0.00333 |
| 601 | 0.00400 |
| 1,642 | 0.00397 |

It is seen from the above results that the PTC devices of Example 3 showed the lower resistance-increasing rates even under the high temperature and high humidity atmosphere, as well as the PTC devices of Examples 1 and 2.

INDUSTRIAL APPLICABILITY

The PTC devices according to the present invention exhibit switching performance which is similar to that of the PTC devices produced using nickel fillers as the conductive fillers, and showed further improved performance in aging change over a long period of time. Therefore, the PTC devices according to the present invention can be widely used in electric apparatuses, etc. similarly to the conventional PTC devices over a longer period of time.

The preset application claims a priority defined in the Paris Convention based on Japanese Patent Application No. 2004-169804 (Title: Polymer PTC Device, filed on Jun. 8, 2004). The disclosures of this Japanese patent application should be incorporated into the present description by such reference to that Japanese patent application.

The invention claimed is:

1. A PTC device comprising (A) a polymer PTC element comprising (1) an electrically conductive filler and (2) a polymer material, and (B) at least one metal electrode disposed on at least one surface of the polymer PTC element, characterized in that the electrically conductive filler is a Ni alloy filler made of a Ni—Co alloy which has oxidation resistance under a high temperature and dry atmosphere, and the polymer material is a thermoplastic crystalline polymer.

2. The PTC device according to claim 1, wherein the Ni alloy filler contains 2 to 20 wt. % of cobalt based on the weight of a whole of the filler.

3. The PTC device according to claim 1, wherein the Ni alloy filler is in the form of fine particles having an average particle size of 5 to 50 μm, said particle size being measured in accordance with the procedure of JIS R-1629 employing a laser diffraction-scattering method.

4. The PTC device according to claim 1, wherein the polymer material is selected from the group consisting of a polyethylene, an ethylene copolymer, a polyvinylidene fluoride and a polyamide.

5. The PTC device according to claim 1, wherein the polymer PTC element is in the form of a layer and has the metal electrodes disposed on its two opposing main surfaces.

6. The PTC device according to claim 1, wherein the metal electrode has a roughened surface which is in contact with the polymer PTC element.

7. The PTC device according to claim 1, wherein the Ni alloy filler is prepared by co-precipitating nickel and another metal which is other than nickel and which constitutes the alloy.

8. A PTC device comprising (A) a polymer PTC element comprising (1) an electrically conductive filler and (2) a polymer material, and (B) at least one metal electrode disposed on at least one surface of the polymer PTC element, characterized in that the electrically conductive filler is a Ni alloy filler which has oxidation resistance under a high temperature and dry atmosphere, and the polymer material is a thermoplastic crystalline polymer and members which constitute the Ni alloy filler comprise cores and a Ni alloy which is present on the surfaces of the cores, said Ni alloy essentially consisting of nickel and other metal which is other than nickel and which constitutes the alloy.

9. The PTC device according to claim 8, wherein the Ni alloy present on the surfaces of the cores contains 9 to 12 wt. % of cobalt.

10. An electric apparatus incorporating a PTC device comprising (A) a polymer PTC element comprising (1) an electrically conductive filler comprising a Ni alloy filler made of a Ni—Co alloy which has oxidation resistance under a high temperature and dry atmosphere, and (2) a polymer material comprising a thermoplastic crystalline polymer, and (B) at least one metal electrode disposed on at least one surface of the polymer PTC element.

11. The electric apparatus according to claim 10, wherein the PTC device functions as a circuit protection device.

* * * * *